US005993226A

United States Patent [19]

Yamaguchi

[11] Patent Number: 5,993,226

[45] Date of Patent: Nov. 30, 1999

[54] STRUCTURE FOR COUPLING CONNECTORS

[75] Inventor: Noboru Yamaguchi, Shizuoka, Japan

[73] Assignee: Yazaki Corporation, Tokyo, Japan

[21] Appl. No.: 08/956,647

[22] Filed: Oct. 23, 1997

[30] Foreign Application Priority Data

Oct. 23, 1996 [JP] Japan ..... 8-280769

[51] Int. Cl.[6] ..... H01R 13/62

[52] U.S. Cl. ..... 439/157; 439/911

[58] Field of Search ..... 439/34, 157, 310, 439/911, 259

[56] References Cited

U.S. PATENT DOCUMENTS 5,178,553 1/1993 Hatagishi ..... 439/157

5,460,530 10/1995 Toba ..... 439/34

FOREIGN PATENT DOCUMENTS 8-83645 3/1996 Japan .

*Primary Examiner*—Neil Abrams

*Assistant Examiner*—Javaid Nasri

*Attorney, Agent, or Firm*—Armstrong, Westerman, Hattori, McLeland & Naughton

[57] ABSTRACT

A connector for an automotive door mounted switch unit and a wiring harness for efficient coupling, having a first connector, with follower projections movably supported on a bracket, a second connector with guide slits for the follower projections on a unit part, a cover panel for the unit part with levers provided with slide slits for the follower projections, the cover panel rotated and assembled to the unit part while bringing the slide slits of the levers into sliding engagment with the follower projections, to move the latter into the guide slits of the second connector and couple the first and second connectors to each other.

10 Claims, 5 Drawing Sheets

STRUCTURE FOR COUPLING CONNECTORS

BACKGROUND OF THE INVENTION

1. Field of the Invention

This invention relates to a structure for coupling connectors which enables connectors, for example, of a switch unit and of a door harness to be automatically coupled to each other on assembling a cover panel to the switch unit.

2. Description of the Related Art

FIG. 7 shows a conventional connector coupling structure as disclosed in Japanese Patent Application Laid-Open Specification No. Hei 8-83645, in which a male connector 61 and a female connector 62 are coupled to each other with a low coupling force through the use of levers 63. The male connector 61 has a pair of follower pins 64 projecting thereon, and the female connector 62 has guide slits 65-for the follower pins 64 and support shafts 66 for the levers 63. The levers 63 are formed with holes 67 for receiving the support shafts 66 and slide slits 68 for the follower pins 64.

The levers 63 are rotatably supported on the female connector 62, with their holes 67 engaged on the support shafts 66. On initially coupling the male connector 61 to the female connector 62, the follower pins 64 engage in the guide slits 65 as well as in the slide slits 68 of the levers 63. As the lever 63 is rotated forwardly (in the direction of the male connector), the follower pins 64 are pushed rearwardly by the slide slits 68 along the guide slits 65, with the result that the male and female connectors 61, 62 are coupled to each other.

With the above conventional structure, however, to couple the male and female connectors 61, 62, an operator needs to hold them with both hands, resulting in a very poor operability especially where one of the connectors 61, 62 is provided on a large-sized member such as an automotive door trim panel 1 or door inner panel 6 as shown in FIG. 8, and the operator must effect the connector coupling in a blind manner through service holes 69 in the door inner panel 6. Further, because the levers 63 are required as a separate member for coupling the connectors 61, 62, an increase has been made in the size of the connectors as a whole.

In FIG. 8, the door inner panel 6 has a wiring harness 70 laid therein which is at one end connected via a grommet 71 to a connector 72—which is in connection with an electric junction box 74 on the side of a vehicle body 73—and at the other end connected to a switch unit 3 on the side of the door trim panel 1. The opening and closing of a power window, the driving of a sideview mirror and the like are effected through operating switches 76 on the switch unit 3.

SUMMARY OF THE INVENTION

This invention has been accomplished to overcome the above drawbacks and an object of this invention is to provide a structure for coupling connectors which enables, for example, a unit part such as a swtich unit and a door inner panel side circuit (door harness) to be efficiently connector-connected to each other with a good operability.

In order to attain the object, according to this invention, there is provided a structure for coupling connectors, which comprises: a first connector with follower projections, which is movably supported on a bracket; a second connector with guide slits for the follower projections, which is provided on a unit part; a cover panel for the unit part, which has levers provided with respective slide slits for the follower projections, wherein the cover panel is rotated to be assembled to the unit part, while bringing the slide slits of the levers into sliding engagement with the respective follower projections to move the respective follower projections into the guide slits of the second connector and couple the first and second connectors to each other.

When the cover panel is preset to the unit part in a one-end supported, inclined, rotatable manner, the follower projections of the first connector engage in the slide slits of the levers of the cover panel. Then, as the cover panel is rotated in an assembling direction of the cover panel to the unit part, the follower projections are guided through sliding engagement with the slide slits of the levers into the guide slits of the second connector. The first connector thus slidingly moves on the bracket into coupling with the second connector.

Advantageously, the structure is used with panels as in an automobile door, and the bracket is provided on a first one of the panels and the unit part is provided on a second one of the panels.

Advantageously, the first panel is a door inner panel and the second panel is a door trim panel.

Advantageously, the unit part is a switch unit having switches with terminals extended into the second connector, and the first connector is attached to a wiring harness.

Advantageously, the cover panel is provided with openings for exposing the switches to the outside.

Advantageously, the levers are provided at a substantially intermediate length of the cover panel.

Advantageously, the first connector is a male connector having the follower projections at opposite sides thereof, the second connector is a female connector having the guide slits at opposite sides thereof, and the levers with the respective slide slits are provided at opposite sides of the cover panel.

Advantageously, the slide slits are curved in a direction opposite a rotation locus of the cover panel.

Advantageously, the cover panel is provided on a side of the unit part opposite a side where the second connector and thus the first connector are provided.

Advantageously, the bracket has a rail along which the first connector is movable.

The above and other objects, features and advantages of this invention will become apparent from the following description and the appended claims, taken in conjunction with the accompanying drawings.

DESCRIPTION OF THE PREFERRED EMBODIMENTS

Embodiments of this invention will now be described in detail with reference to the attached drawings.

Figure 1:
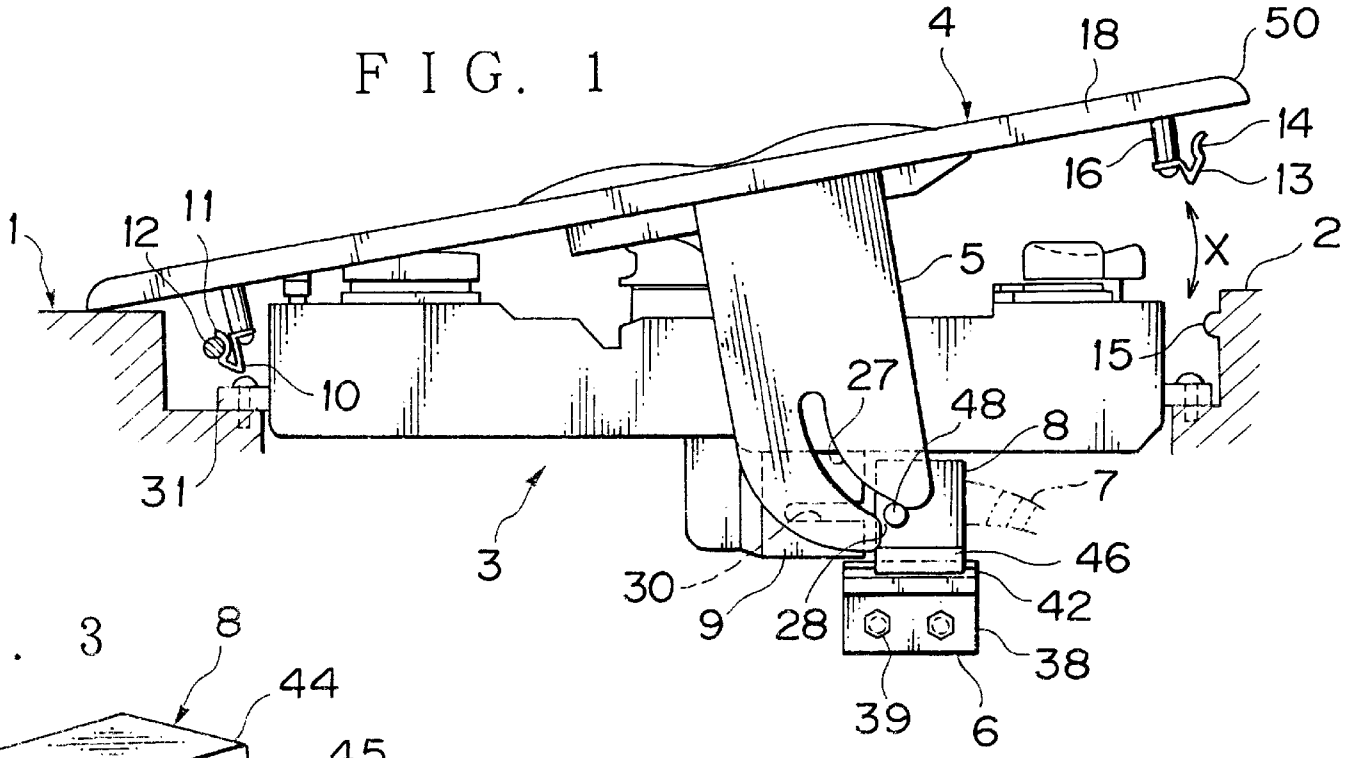
FIG. 1 is a side view of a connector coupling structure according to one embodiment of this invention.
Figure 2:
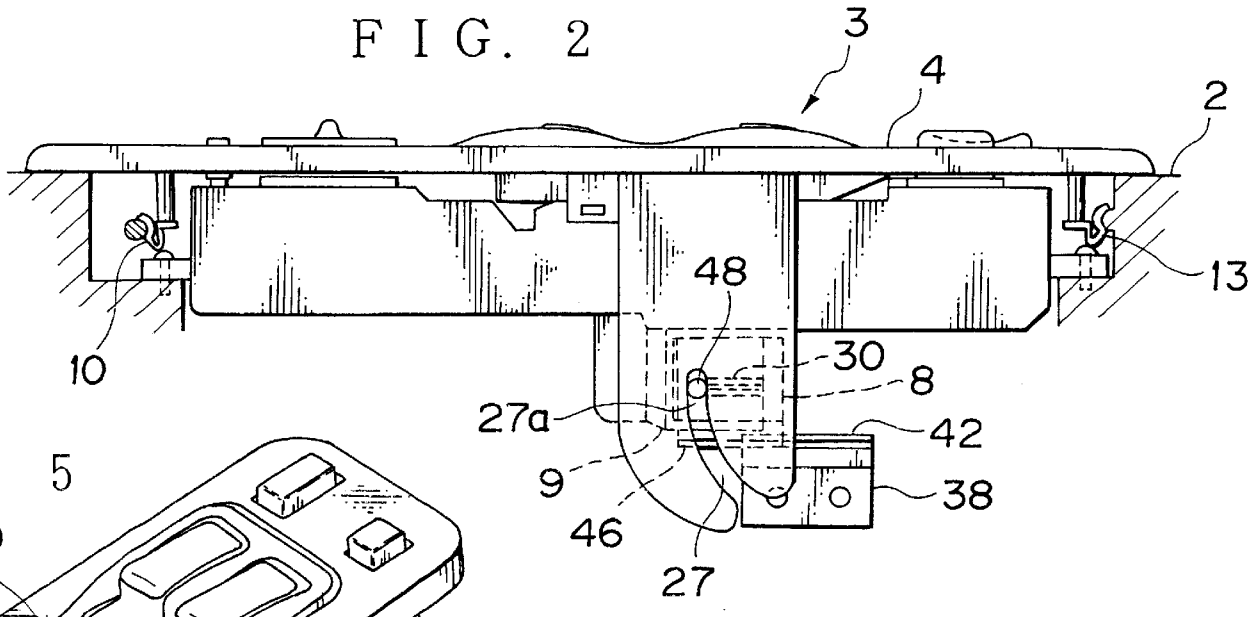
FIG. 2 is a side view similar to FIG. 1, in which connectors are coupled.
Figure 8:
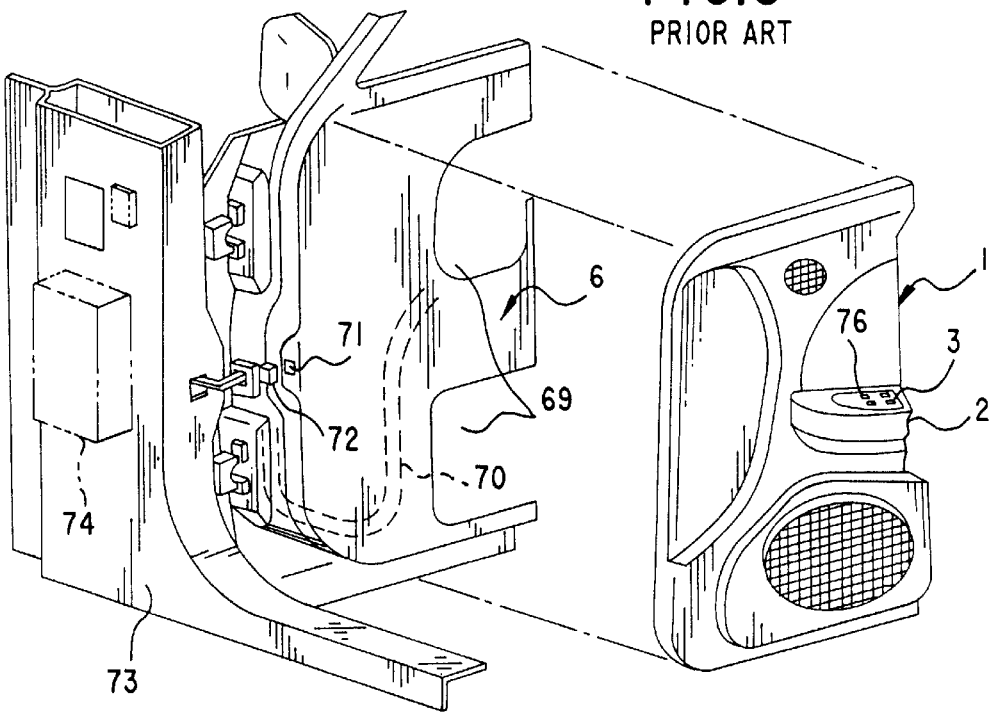
FIG.8 PRIOR ART
FIG. 8 is an exploded perspective view of a conventional coupling showing how a door trim panel is assembled to a door inner panel.
Figure 7:
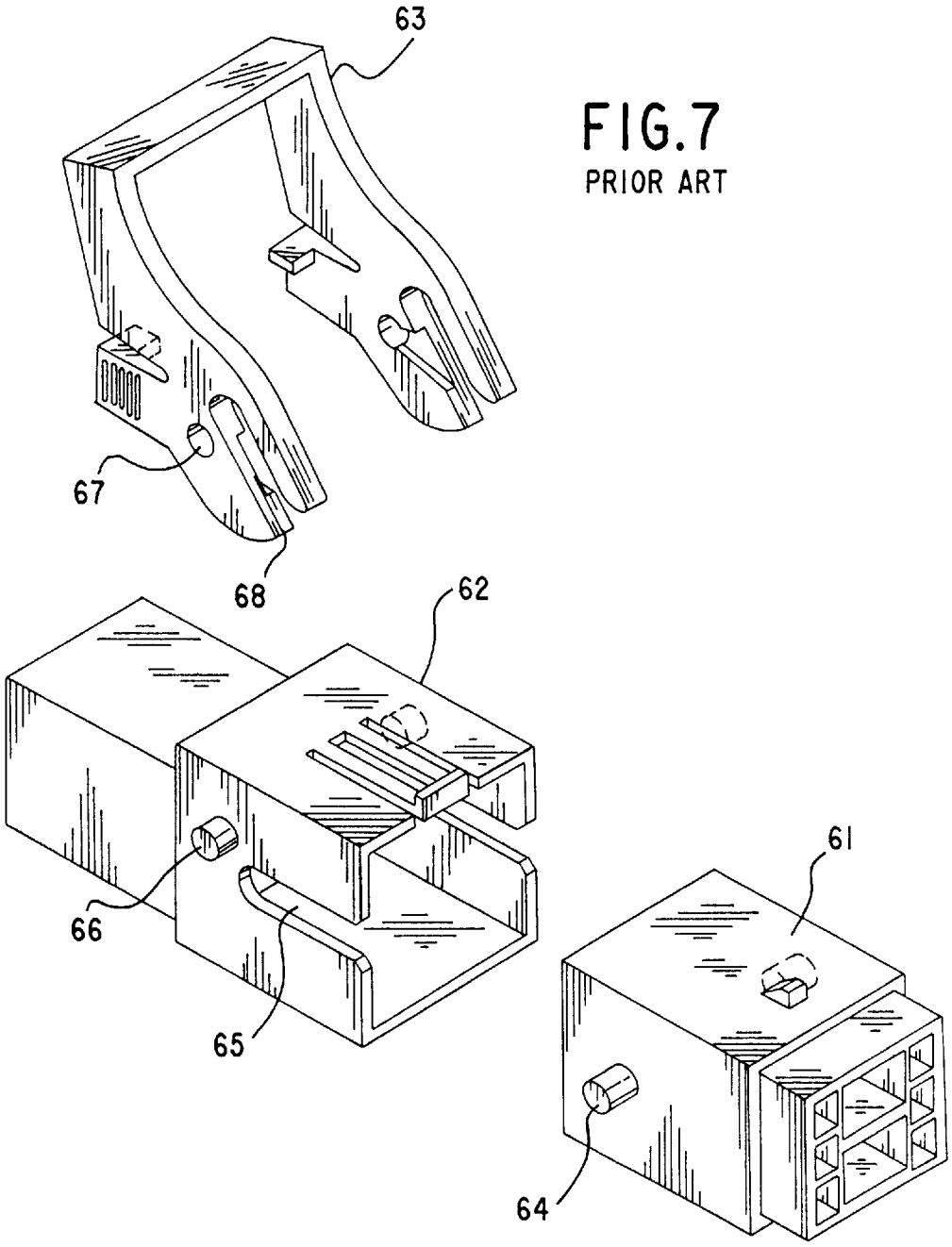
FIG.7 PRIOR ART
FIG. 7 is an exploded perspective view of a conventional connector coupling structure.

As best seen in FIGS. 1 and 2, a switch unit (unit part) 3 is provided on an armrest 2 of a door trim panel (at reference numeral 1 in FIG. 8). A cover panel (decorative panel) 4 of synthetic resin, which is provided with levers 5, is rotated to be assembled to the switch unit 3 so that the levers 5 guide a male connector 8 of a door harness 7 on the side of a door inner panel (at reference numeral 6 in FIG. 8) into coupling with a female connector 9 of the switch unit 3. This switch unit 3 is mainly for use with a power window.

Figure 4:
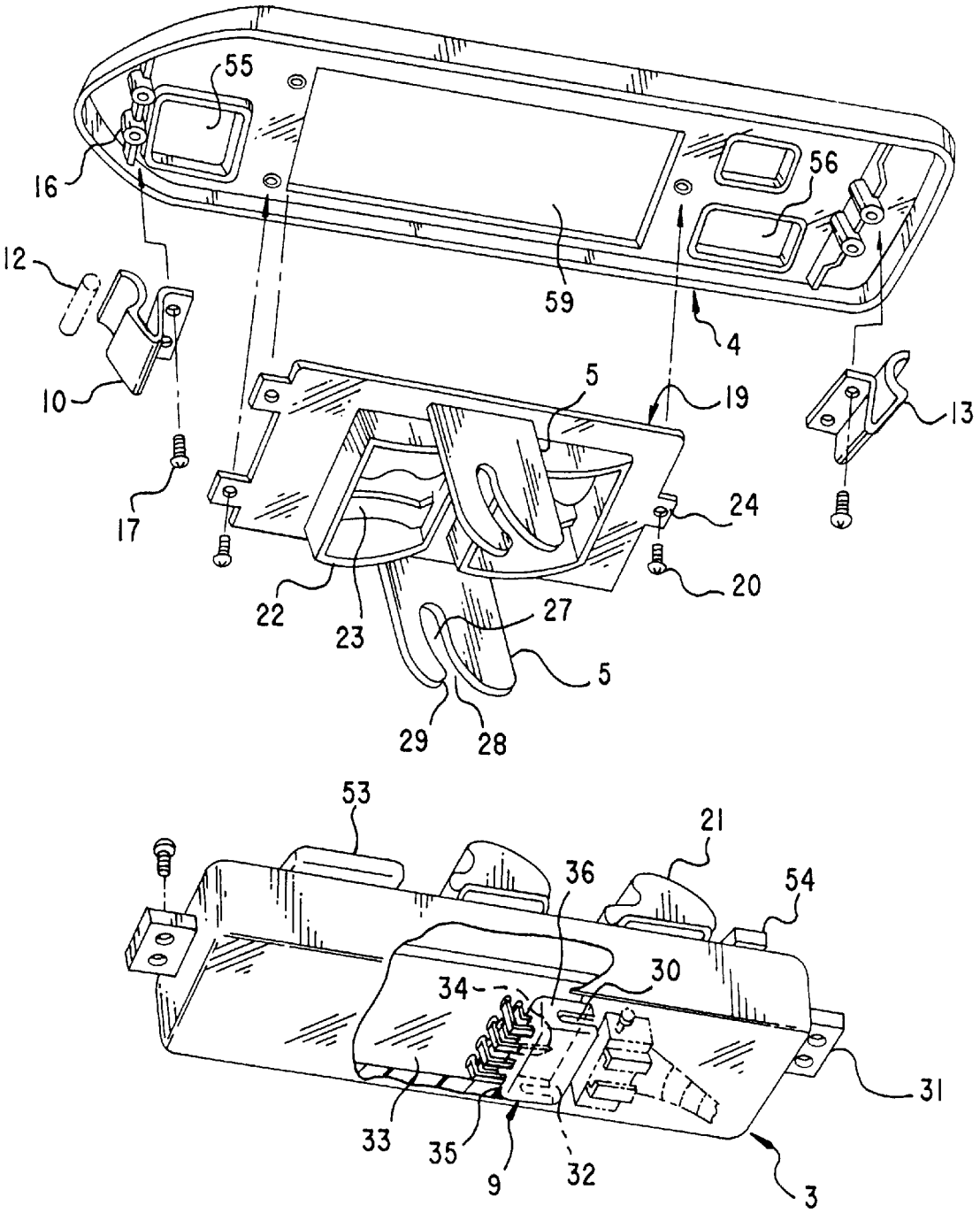
FIG. 4 is an exploded partially cutaway perspective view of the connector-coupling structure.

In FIG. 1, the cover panel 4 of the switch unit 3 is vertically rotatable as indicated by an arrow X by means of a spring piece 10 near the front end thereof, which has a claw 11 slidably engaged on a rotation supporting pin 12 provided to the arm rest 2. The cover panel 4 is also provided with a like spring piece 13 near the rear end, which has a claw 14 engageable, in the present example, on an engagement projection 15 on the arm rest 2. The cover panel 4 is thus via the spring pieces 10, 13 supported on and fixed to the arm rest 2 and in this way assembled to the switch unit 3. As best seen in FIG. 4, the spring pieces 10, 13 are fixed to related supports 16 by means of small screws 17, the supports depending from the underside of the cover panel 4.

Figure 5:
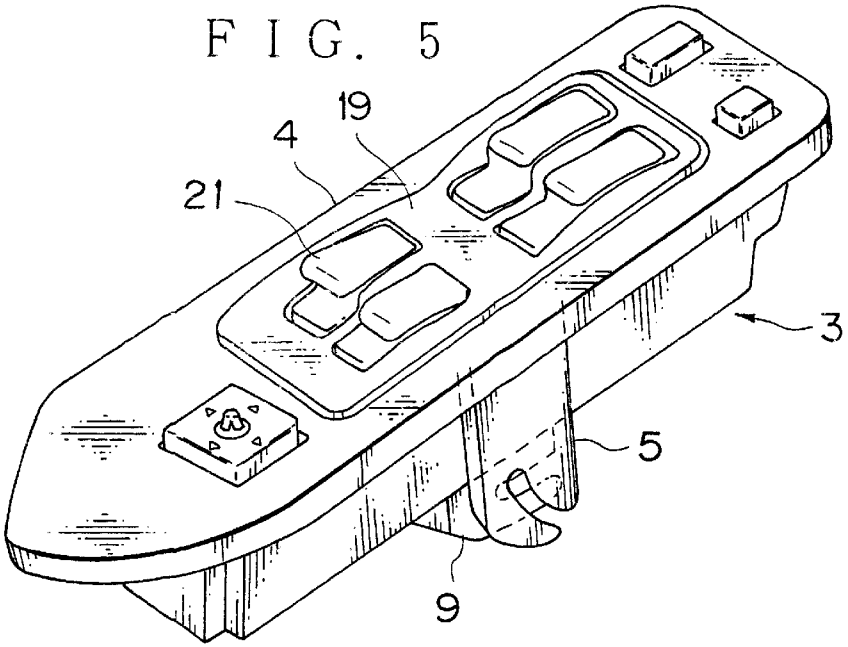
FIG. 5 is a perspective view of a switch unit.

In FIG. 1, the cover panel 4 is on the underside at an intermediate length thereof provided with a pair of the levers 5 which extend perpendicularly downwardly in parallel with each other. As shown in FIG. 4, the cover panel 4 has a synthetic-resin made switch bezel 19 fixed thereto with small screws 20, and the pair of levers 5 are integrally provided at opposite sides of the bezel to extend downwardly. The cover panel 4 has an opening 59 for the switch bezel 19 and smaller openings 55, 56 for switches 53, 54. The switch bezel 19 has frames 22 for receiving therein switches 21 provided on the switch unit 3 and openings 23 for exposing the switches 21 to the outside as well as fixing pieces 24 for use in fixing the switch bezel 19 to the cover panel 4. The switch bezel 19 is assembled to the cover panel 4 as shown in FIG. 5, and the switch unit 3 is arranged under the cover panel 4 with the switch bezel 19. The switch bezel 19 may be formed an an integral part of the cover panel 4.

As best seen in FIGS. 1 and 4, each lever 5 is formed with a curved cam-shaped slide slit 27. The slide slit 27 has an inlet 28 at the lower end of the lever 5 and is curved forwardly in an arc at the inlet 28. In other words, the slide slit 27 is curved in a direction opposite the rotation locus of the cover panel 4, and the center of curvature of the slide slit 27 and the center of rotation of the cover panel 4 are located apart in opposite directions. Front and rear sides of the slide slit inlet 28 are curved to provide guide portions 29 (FIG. 4).

As shown in FIG. 1, in the condition of the cover panel 4 opened (the condition where the cover panel 4 is at the front supported via the spring piece 10 and at the rear raised upwardly), the inlet 28 of the slide 27 and a guide slit 30 of the connector 9 of the switch unit 3 are located close to each other in a crosswise manner.

As shown in FIGS. 1 and 4, the switch unit 3 is at front and rear brackets 31 thereof screwed to the armrest 2. The switch unit 3 is on top thereof provided with the switches 21 and at the underside provided with the female connector 9. The female connector 9 has at the rear end a connector coupling opening 32 (FIG. 4) which opens rearwardly. As shown in FIG. 4, male terminals 34 extend into the female connector 9 from a circuit substrate 33 inside the switch unit 3. The female connector 9 has a housing 35 of synthetic resin which is at opposite lateral walls 36 formed with the guide slits 30 extending horizontally. The guide slits 30 and the slide slits 27 of the levers 5 are located crosswise.

Figure 3:
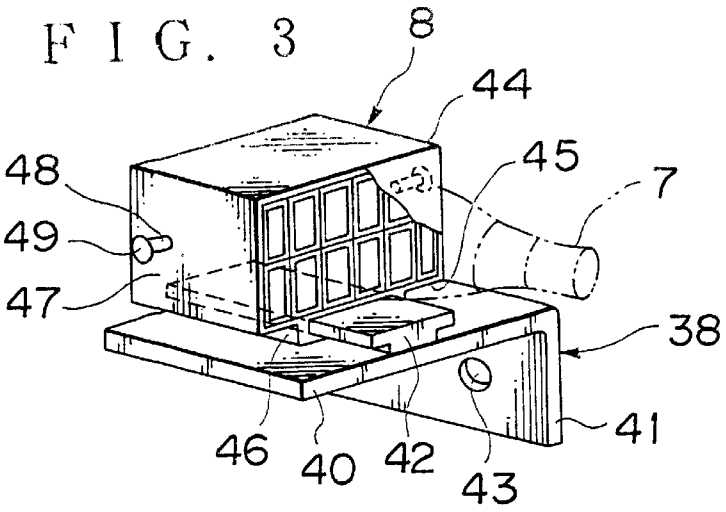
FIG. 3 is a perspective view of a male connector attached to a door harness.

As shown in FIGS. 1 and 3, to the door inner panel (at 6 in FIG. 1) are fixed a bracket 38 by means of bolts 39, on which bracket the male connector 8 attached to the door harness 7 is longitudinally slidably provided. The bracket 38, as shown in FIG. 3, consists of a top plate 40 and a side plate 41 to have an L-shape. A rail 42 of substantially T shape in cross section is provided extending longitudinally at the center on the top plate 40. The side plate 41 is formed with bolt insertion holes 43.

The male connector 8 has a housing 44 of synthetic resin which is at the underside 45 provided with a pair of slide guides 46 of substantially L shape in cross section which engage the rail 42 to allow the male connector 8 to slide longitudinally. The male connector housing 44, on opposite lateral walls 47 thereof near the front end, has a pair of short follower projections 48 of circular cross section which engage both in the guide slits 30 of the female connector 9 and the slide slits 27 of the levers 5. Each follower projection 48 has a larger-diameter guide flange 49 at the free end. Inside the male connector 8 are received not-shown female terminals which are attached to the door harness 7.

In the condition of the cover panel 4 opened as shown in FIG. 1, the follower projections 48 of the male connector 8 engage in the inlets 28 of the slide slits 27 of the levers 5. From this condition, the cover panel 4 is pushed and rotated downwardly to bring the levers 5 into engagement with the related follower projections 48 such that when moved a short distance along the slide slits 27 from the position as shown in FIG. 1, the follower projections 48 are guided into the guide slits 30 of the female connector 9 and, as the cover panel 4 is further rotated, moved horizontally along the guide slits 30. The male connector 8, together with the follower projections 48, is horizontally moved along the rail 42 on the bracket 38 and coupled to the female connector 9 as shown in FIG. 2.

In FIG. 1, the rotation of the cover panel 4 is effected by pushing its rear end 50. The levers 5, being arranged at an intermediate length of the cover panel 4, form a point of action of the lever constituted by the cover panel 4, with the result that the male and female connectors 8, 9 can be coupled to each other with a smaller coupling force than otherwise required.

As shown in FIG. 2, in the condition of the cover panel 4 closed (the condition where the cover panel 4 is assembled over the switch unit 3), the follower projections 48 are located substantially at the terminal of vertical portions 27*a* of the slide slits 27 and at the terminal of the horizontal guide slits 30. The terminal side vertical portions 27*a* of the slide slits 27 are in this position perpendicular to the horizontal guide slits 30. The thus formed slide slits 27 enable a smooth and reliable guiding of the follower projections 48 and thus a smooth and reliable coupling of the connector 8.

Figure 6:
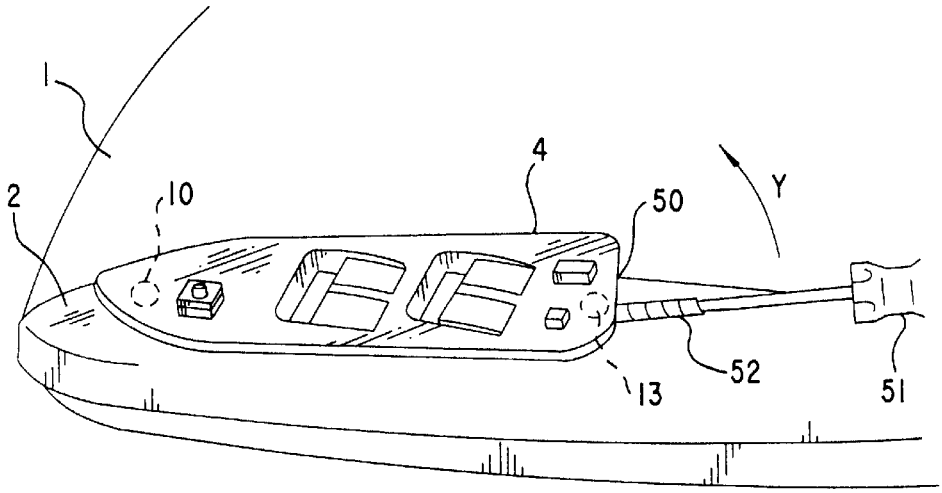
FIG. 6 is a perspective view showing how the switch unit is detached.

FIG. 6 shows the cover panel 4 about to be detached. The front end of a screw driver 51 is wound with a protective tape 52 and is squeezed under the cover panel 4 at the rear end to raise the same and to disengage the spring piece 13, with care not to damage the cover panel 4. The cover panel 4 is then rotated by hand about the rotation supporting pin 12 as indicated by an arrow Y, so that the follower projections 48 of the male connector 8 move rearwardly along the slide slits 27 of the levers 5 and the guide slits 30 of the female connector 9 in the order of FIG. 2 to FIG. 1, and that the male connector 8 slides along the rail 42 on the bracket 38 to be decoupled from the female connector 9. The decoupling of the connector 8 is also effected smoothly and reliably with a low force through the leverage of the cover panel 4.

The above-mentioned construction for rotating the cover panel 4 from FIG. 1 to FIG. 2 and coupling the connector 9 of the switch unit 3 and the connector 8 of the door harness 7 is also effective as a connector coupling method.

According to the present embodiment of this invention, because connectors of the switch unit 3 and of the door harness 7 are coupled simultaneously with the setting of the cover panel 4, it is unncessary to couple the connectors by hand as in the related art described hereinabove and, moreover, the connector coupling operation is eliminated, resulting in the switch unit 3 efficiently assembled and connected. Because the cover panel 4 is integrally provided with the levers 5, it is unnecessary to set levers on one of the connectors to be coupled as in the related art, and thus an increase in the size of the connectors as a whole is prevented. Thus, the switch unit 3 and the door harness 7 can be reliably and smoothly connector-connected inside a confined space at the armrest 2. Further, because it is unnecessary to provide levers which are separate from the connector, a reduction in the number of parts is attained, leading to a reduction in the cost of connectors. Further, because the cover panel 4 is as a whole utilized as a lever, a great reduction is made in the force required for moving one connector into the other. Because a wiring harness needs not be pulled out as in the conventional coupling of a switch connector, an improvement in operability is also made in this respect, i.e., only the setting of the cover panel 4 attains the coupling of the connectors, and an extra length of the wiring harness is unnecessary, making it possible for the harness to be laid neat. Further, because the male and female connectors 8 and 9 are coupled in a longitudinal direction of a vehicle, if the door trim panel 1 (armrest 2) is pulled toward the cabin side of the vehicle, the connectors 8 and 9 do not accidentally get detached, improving the reliability of the electric connection.

Having now fully described the invention, it will be apparent to one of ordinary skill in the art that many changes and modifications can be made thereto without departing from the spirit and scope of the invention as set forth herein.

What is claimed is:

1. A structure for coupling connectors together comprising:

a first connector movably supported on a bracket and having follower projections projecting outwardly from opposite sides of said first connector;

an unit part provided with a second connector, said second connector having guide slits for receiving said follower projections;

a leverage cover panel provided on a side of said unit part remote from said second connector, said cover panel having a pair of oppositely facing, vertical leverage members, with curved, cam shaped slide slits therein for receiving said first connector follower projections, said cover panel being rotatable supported at one end thereof longitudinally spaced from a portion where said leverage members are provided, wherein said cover panel is rotated to be assembled to said unit part, while bringing said slide slits of said levers into sliding engagement with said respective follower projections to move said respective follower projections into said guide slits of said second connector and couple said first and second connectors to each other.

2. The structure according to claim 1, which is used with panels as in a vehicle door, and wherein said bracket is provided on a first one of said panels and said leveraged cover panel is provided on a second one of said panels.

3. The structure according to claim 2, wherein said first panel is a door inner panel and said second panel is a door trim panel.

4. The structure according to claim 1, wherein said first connector is a switch unit having switches with terminals extended into said second connector, and said first connector is attached to a wiring harness.

5. The structure according to claim 4, wherein said cover panel is provided with openings for exposing said switches to the outside.

6. The structure according to claim 1, wherein said levers are provided at a substantially intermediate length of said cover panel.

7. The structure according to claim 1, wherein said first connector is a male connector having said follower projections at opposite sides thereof, said second connector is a female connector having said guide slits at opposite sides thereof, and said levers with said respective slide slits are provided at opposite sides of said cover panel.

8. The structure according to claim 1, wherein said slide slits of said leverage members are curved in a direction opposite a direction of a rotation locus made by said cover panel so that centers of curvature of said slide slits and of rotation of said cover panel are located apart in opposite directions.

9. The structure according to claim 1, wherein said bracket has a rail along which said first connector is movable.

10. A structure for coupling connectors together comprising:

a first connector movably supported on a bracket and having follower projections projecting outwardly from opposite sides of said first connector;

a unit part provided with a second connector, said second connector having guide slits for receiving said follower projections; and a leverage cover panel provided on a side of said unit panel remote from said second connector, said cover panel having a pair of oppositely facing, vertical leverage members, with curved, cam shaped slide slits, therein, each of said vertical members receiving said first connector follower projections and said second connector follower projects therebetween, wherein said cover panel is rotated to be assembled to said coupling connectors, while bringing said slide slits of said levers into sliding engagement with said respective follower projections to move said respective follower projections into said guide slits of said second connector and couple said first and second connectors to each other.

* * * * *